US010335831B2

(12) United States Patent
Künzle et al.

(10) Patent No.: US 10,335,831 B2
(45) Date of Patent: Jul. 2, 2019

(54) SIEVE CLEANERS, SIEVE UNIT, AND METHODS

(71) Applicant: BÜHLER AG, Uzwil (CH)

(72) Inventors: Simon Künzle, Kirchberg (CH); Nicolas Egger, Flawil (CH)

(73) Assignee: BÜHLER AG, Uzwil (CH)

( * ) Notice: Subject to any disclaimer, the term of this patent is extended or adjusted under 35 U.S.C. 154(b) by 0 days.

(21) Appl. No.: 15/521,056

(22) PCT Filed: Oct. 22, 2015

(86) PCT No.: PCT/EP2015/074535
§ 371 (c)(1),
(2) Date: May 12, 2017

(87) PCT Pub. No.: WO2016/062826
PCT Pub. Date: Apr. 28, 2016

(65) Prior Publication Data

US 2017/0333950 A1 Nov. 23, 2017

(30) Foreign Application Priority Data

Oct. 24, 2014 (EP) ..... 14190278

(51) Int. Cl.
*B07B 1/54* (2006.01)
*B07B 1/52* (2006.01)

(52) U.S. Cl.
CPC ..... *B07B 1/54* (2013.01); *B07B 1/522* (2013.01)

(58) Field of Classification Search
CPC .. B07B 1/50; B07B 1/52; B07B 1/526; B07B 1/54
(Continued)

(56) References Cited

U.S. PATENT DOCUMENTS 425,920 A 4/1890 Watson
946,548 A 1/1910 Johnston et al.
(Continued)

FOREIGN PATENT DOCUMENTS

CH 379 890 9/1964
CN 202263724 U 6/2012
(Continued)

OTHER PUBLICATIONS

European Search Report Corresponding to 14 19 0278 dated Apr. 8, 2015.
(Continued)

*Primary Examiner* — Joseph C Rodriguez
(74) *Attorney, Agent, or Firm* — David & Bujold PLLC; Michael J. Bujold

(57) ABSTRACT

Sieve cleaners (1) for cleaning a sieve surface (2) of a sieve box (3), which sieve box contains a sieve surface (2) and bottom (4). The sieve cleaners (1) contain a wobble foot (5), which extends along a main axis (A) of the sieve cleaner (1) and is designed such that the wobble foot can be placed onto the sieve bottom (4) and the sieve cleaner (1) can be tipped about the wobble foot (5). At least one cleaning element (6) has a cleaning region (7), and each cleaning region (7) has a plurality of cleaning surfaces (8) for cleaning the sieve surface (2). The cleaning surfaces (8) are each designed for at least linear contact with the sieve surface (2) and are separated from one another by slots (9) formed in the cleaning region (7). Sieve units and methods for upgrading or converting a sieve box are also disclosed.

13 Claims, 6 Drawing Sheets

Figure 1:
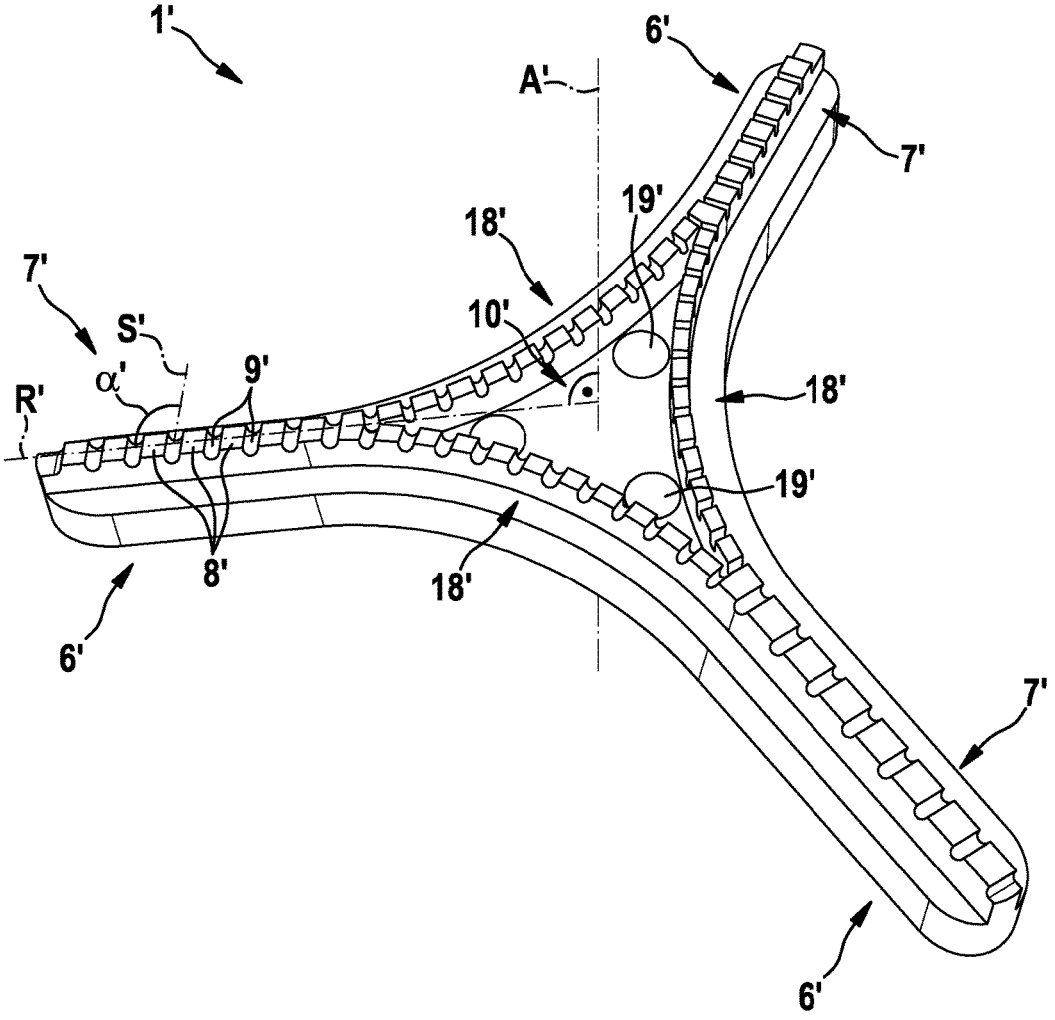

(58) Field of Classification Search
USPC ..... 209/379, 381, 382, 385, 386
See application file for complete search history.

(56) References Cited

U.S. PATENT DOCUMENTS

| | | | | |
|---|---|---|---|---|
| 1,925,447 | A | 9/1933 | Keefer | |
| 2,086,199 | A | 7/1937 | Williams | |
| 2,304,325 | A | 12/1942 | Williams et al. | |
| 3,960,731 | A | 6/1976 | Brandt | |
| 5,213,216 | A * | 5/1993 | Suehiro | B01D 33/0346 209/236 |
| 5,385,240 | A | 1/1995 | Egan, III et al. | |
| 5,538,139 | A | 7/1996 | Keller | |
| 6,095,339 | A | 8/2000 | Filip | |
| 6,336,557 | B1 | 1/2002 | Rüter | |
| 9,486,835 | B2 * | 11/2016 | Kising | B07B 1/40 |
| 2008/0017555 | A1 * | 1/2008 | Schumacher | B07B 1/52 209/379 |
| 2015/0239012 | A1 * | 8/2015 | Kising | B07B 1/40 209/350 |
| 2017/0274421 | A1 * | 9/2017 | Shank | B07B 13/16 |

FOREIGN PATENT DOCUMENTS

| | | | |
|---|---|---|---|
| CN | 203253633 | U | 10/2013 |
| DE | 164 924 | | 3/1904 |
| DE | 601 481 | C | 8/1934 |
| DE | 645 400 | C | 5/1937 |
| DE | 645 401 | C | 5/1937 |
| DE | 873 345 | C | 4/1953 |
| DE | 1 507 747 | A1 | 7/1969 |
| DE | 24 11 455 | A1 | 10/1975 |
| DE | 79 36 430 | U1 | 7/1980 |
| DE | 29 52 215 | A1 | 7/1981 |
| DE | 86 31 814 | U1 | 2/1987 |
| DE | 36 40 569 | A1 | 6/1988 |
| DE | 90 15 461 | U1 | 1/1991 |
| DE | 10 2006 005 970 | A1 | 8/2007 |
| EP | 0 536 803 | B1 | 8/1995 |
| EP | 0 694 341 | A1 | 1/1996 |
| EP | 0697920 | B1 | 2/1996 |
| EP | 2 465 616 | A1 | 6/2012 |
| GB | 3845 | | 2/1913 |
| GB | 956 982 | | 4/1964 |
| GB | 1134640 | | 11/1968 |
| JP | S4310145 | Y1 | 5/1968 |
| JP | S45-13023 | | 6/1970 |
| JP | S59-142073 | | 9/1984 |
| JP | H5-80570 | | 11/1993 |
| JP | 2000189894 | A | 7/2000 |
| JP | 2014079718 | A | 5/2014 |
| WO | 99/28053 | A1 | 6/1999 |
| WO | 2010/045284 | A1 | 4/2010 |

OTHER PUBLICATIONS

Japanese Office Action issued in corresponding Japanese Patent Application No. 2017-522340 dated Mar. 28, 2018.
Chinese Office Action issued in corresponding Chinese Patent Application No. 201580068119.5 dated Oct. 15, 2018.
Japanese Office Action issued in corresponding Japanese Patent Application No. 2017-522340 dated Feb. 12, 2019.

* cited by examiner

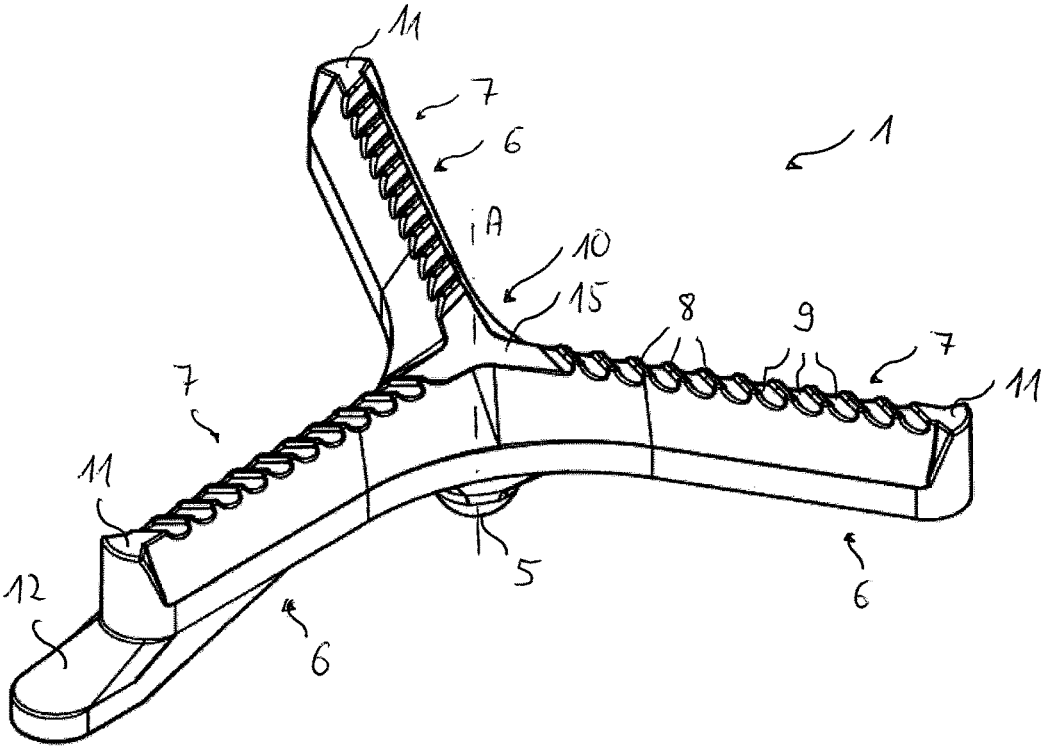
Figur 5
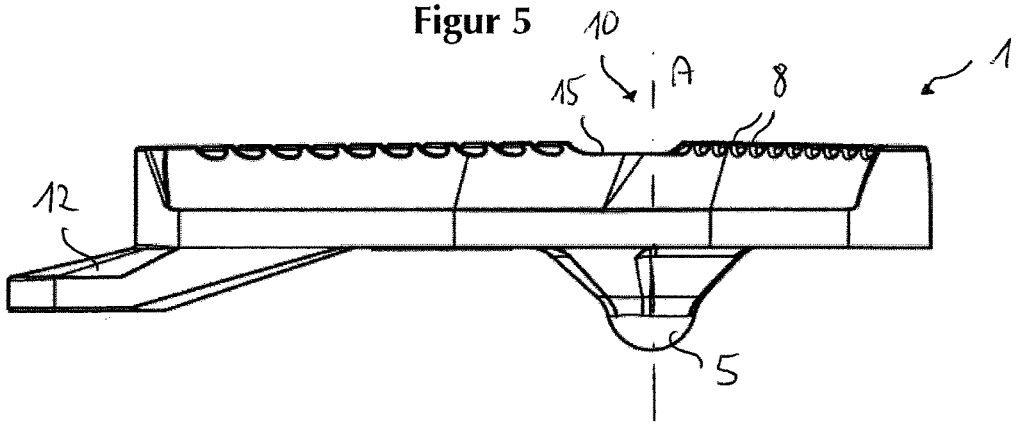
Figur 6
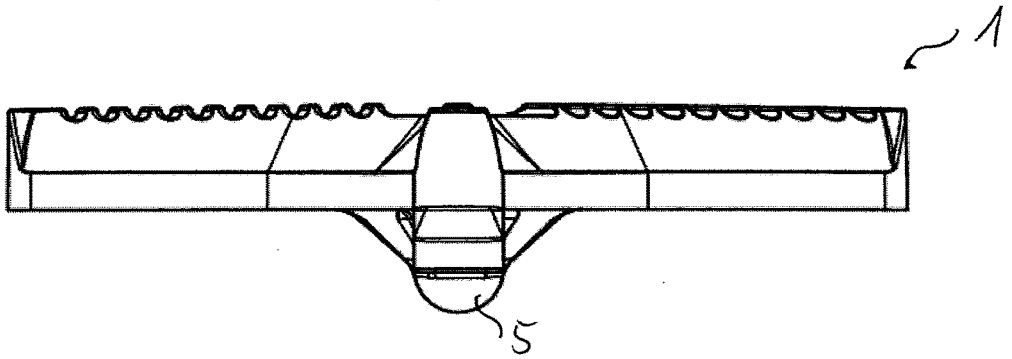
Figur 7

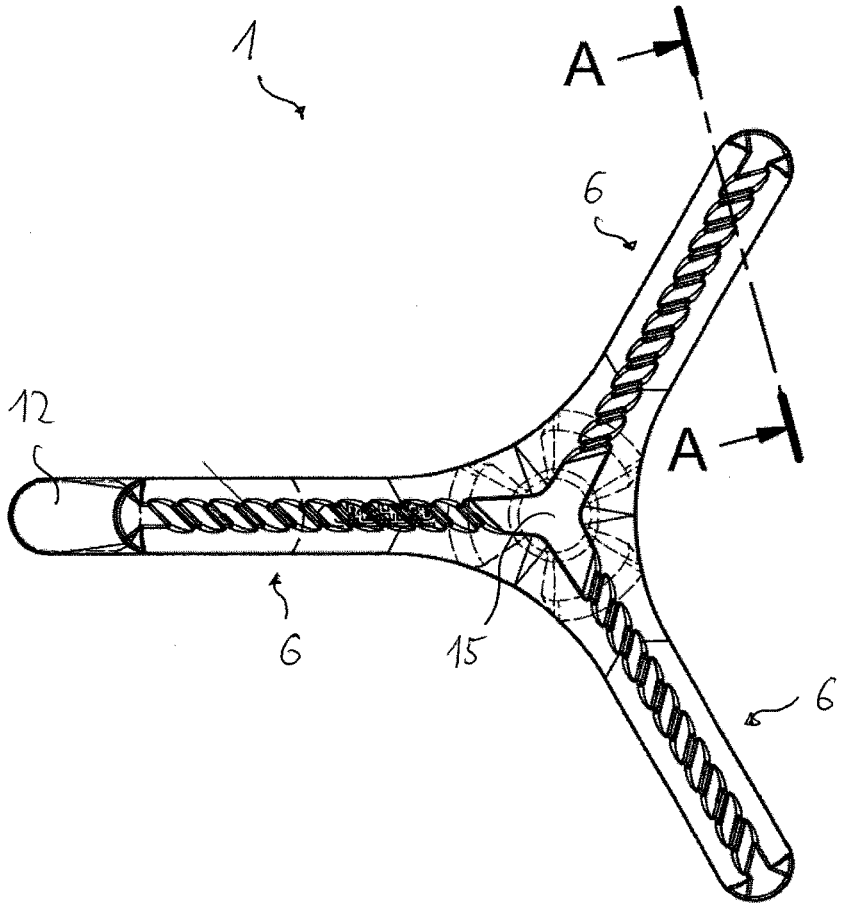
Figur 8
A-A ( 2 : 1 )
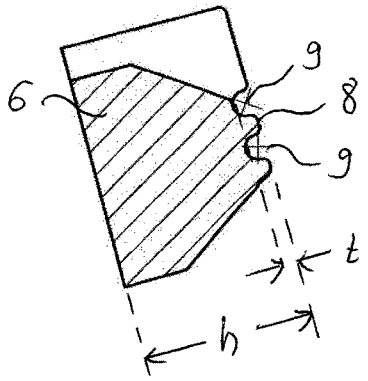
Figur 9

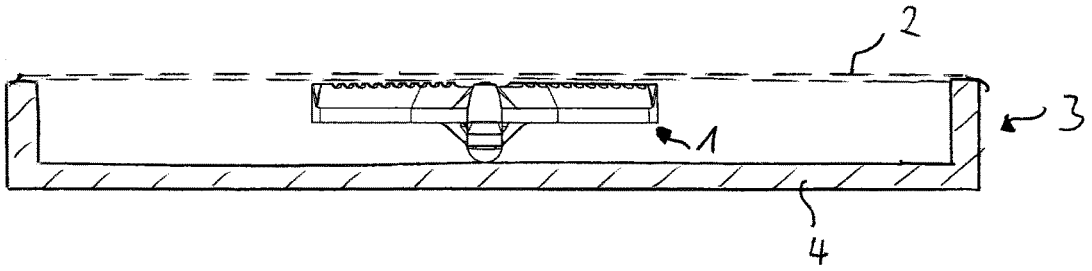
Figur 10

SIEVE CLEANERS, SIEVE UNIT, AND METHODS

The invention relates to a sieve cleaner for cleaning a sieving surface of a sieving tray, said sieving tray containing the sieving surface and a sieve bottom. A sieve cleaner of this kind may, in particular, be configured to clean a sieving surface of a sieving tray of a plan sifter. Furthermore, the invention relates to a sieve unit and a method for upgrading or modifying a sieving tray.

Movable sieve cleaners which can be placed on a sieve bottom of a sieving tray and with the help of which a sieving surface of the sieving tray can be cleaned are known per se. Sieves of this kind are stackable and can be arranged as sieve stacks in plan sifters, for example, in order to separate or sift granular to floury products into different fractions and qualities. The sieve cleaners in this case absorb the vibrating movements of the plan sifter and the sieving trays and, as a result of this, are moved around randomly on the sieve bottom, wherein they repeatedly rebound against the sieve frame.

Generic sieve cleaners are known from EP 0 694 341 B1, for example. These sieve cleaners contain a wobble foot which extends along a neutral axis of the sieve cleaner and is configured in such a manner that it can be placed on the sieve bottom and the sieve cleaner can be tilted about the wobble foot. The movement is influenced by inertia, the sliding friction between the wobble foot and the sieve bottom and by the asymmetric structure of the sieve cleaner. The actual cleaning action is achieved by rounded burls or brushes which, due to the wobbling movement of the sieve cleaner, strike the sieving surface and/or slide along it. In this case, brushes tend to be used for finer sieving surfaces with mesh widths in the region of 85 to 250 μm, for example, and burls for coarser sieving surfaces with mesh widths of 250 μm or more, for example. Similar sieve cleaners, in which the cleaning is performed by burls or brushes striking the sieving surface, are also disclosed in DE 10 2006 005 970 A1, U.S. Pat. No. 6,095,339 A, DE 36 40 569 A1, DE 24 11 455 A1, DE 29 52 215 A1, DE 79 36 430 U1, DE 90 15 461 U1, DE 86 31 814 U1, EP 0 536 803 B1, EP 2 465 616 A1, WO 99/28053 A1, DE 1 507 747 A1, DE 873 345 C, U.S. Pat. No. 2,086,199 and DE 164924.

All these sieve cleaners known in the art have certain disadvantages, however. The bristles of the brushes can fall out in time due to mechanical stresses, something that is unacceptable from a hygienic standpoint—particularly when the sieving cleaners are used in plan sifters in which foodstuffs such as grain or milled grain products, for example, are sifted. It has been shown that sieve cleaners with burls have a tendency to smear the product layer adhered to the sieve surface even further rather than removing it. Furthermore, many of the known sieve cleaners have proved not to be particularly efficient, as they only clean the sieve surface to an inadequate extent.

More compact sieve cleaners are also disclosed in U.S. Pat. No. 1,925,447 and WO 2010/045284 A1. These sieve cleaners are made up of simple geometric figures such as balls, cylinders and polyhedrons. Tests involving at least similar sieve cleaners have shown, however, that they tend to cause a blockage in the sieving surface.

In view of the disadvantages of the state of the art, a problem addressed by the present invention is that of providing an improved and/or alternative sieve cleaner. In particular, the sieve cleaner should clean the sieving surface as efficiently as possible, without damaging the sieve cleaner or the sieve frame, wherein the hygiene requirements in terms of food processing should also be met.

As part of costly and extensive test series, a plurality of very different forms of possible sieve cleaners was tested to see if they met the above requirements. For example, sieve cleaners with silicone cloths or with aluminum pins instead or burls or brushes were used, eccentric focal points were produced, the elastic properties were varied, influences of the dimensions and the ratios thereof were evaluated, etc. As these test series revealed, the sieve cleaners described and claimed below have proved to be particularly advantageous.

The aforementioned problems are therefore solved by a sieve cleaner in a first aspect of the invention. This sieve cleaner is designed for cleaning a sieving surface of a sieving tray, said sieving tray containing the sieving surface and a sieve bottom. The sieving surface may be a sieve fabric, for example. The sieve cleaner may be designed to clean a sieving surface such as a sieve fabric, a sieving tray of a plan sifter, for example. The sieve cleaner contains a wobble foot which extends along a main axis of the sieve cleaner and is configured in such a manner that it can be placed on the sieve bottom and the sieve cleaner can be tilted around about this wobble foot. The aforementioned main axis may, for example, be a neutral axis of the sieve cleaner. Furthermore, the sieve cleaner contains at least one cleaning element with a cleaning region, wherein the, or each, cleaning region has a plurality of cleaning surfaces for cleaning the sieving surface.

According to the invention, the cleaning surfaces are each designed for an at least linear contact with the sieving surface and separated from one another by slots formed in the cleaning region.

Linear contact in this case and in the following should be taken to mean one-dimensional contact—by contrast with punctiform, so zero-dimensional, contact, which exists between a rounded burl or bristle ends known from the state of the art and a planar sieve surface. The expression "at least linear" in this case also includes planar, so two-dimensional, contact.

The at least linear contact leads to the cleaning surfaces during rotation about the main axis of the sieve cleaner sweeping over a planar, in other words two-dimensional, region of the sieving surface. In this way, a substantial proportion of the cleaning is achieved by wiping the fine material from the sieving surface which has passed through said surface. Tapping, such as that mainly caused by the burls known from the state of the art, can therefore be more or less disregarded. Consequently, the damage to the sieving surface that accompanies this tapping is also reduced. The slots formed in this case between the cleaning surfaces ensure that some of the fine material is able to pass through these slots. The fine material in the cleaning regions is thereby prevented from simply being wiped into the sieving surface or the sieving surface is prevented from being pushed away from the sieve cleaner due to the fine material which is accumulating. All in all, therefore, the sieve cleaners according to the invention have the advantage that they can clean the sieving surface at least as well or even more efficiently than the state-of-the-art versions. This advantage also applies to sieving surfaces, in particular sieve fabrics, with relatively small mesh widths, for which sieve cleaners with bristles are used in the state of the art, in particular, therefore, for sieving surfaces with mesh widths of less than 250 μm, preferably of less than 180 μm, more preferably of less than 150 μm, even more preferably of less than 125 μm and particularly preferably of less than 90 μm.

The wobble foot may be rounded, as a result of which tilting is simpler and the freedom of movement of the sieve cleaner can be increased. The cleaning region preferably contains no brushes. Consequently, since no bristles can be pulled out the sieve cleaner is able to meet hygiene requirements.

The slots preferably extend in a slot direction which forms an angle with a radial direction in respect of the main axis which is in the region of 0° to 90°, preferably of 30° to 60°, and particularly preferably of 40° to 50°, and quite particularly preferably is 45°. Angles of this kind ensure that there are more wiping edges which are particularly useful in different movement directions.

Where there is rotation about the main axis, the cleaning surfaces sweep over an imaginary cleaning line in each case, in a radial direction in respect of the main axis. The ratio of the radial spacing of two adjacent cleaning lines and the radial length of the cleaning lines preferably lies in the region of 50% and 100%, particularly preferably of 90% and 95%.

Alternatively, it is also conceivable and falls within the framework of the invention for the cleaning lines of the individual cleaning surfaces to be directly joined to one another or even overlap one another.

The cleaning elements, in particular the preferred cleaning arms explained further down, may exhibit a height parallel to the main axis and the slots may exhibit a depth parallel to the main axis. The ratio between the depth of the slots and the height of the cleaning elements, in particular the cleaning arms, is preferably greater than 0% and smaller than, or equal to, 20%; the ratio is preferably roughly 10%. The greater this ratio, the smaller the sliding friction between the sieve cleaner and sieving surface and the accumulation of fine material at a given height of the cleaning elements and the smaller the risk of the sieve cleaner breaking down. Excessively high ratios, on the other hand, would result in an excessively large amount of fine material accumulating in the slots.

The slots of one and the same cleaning element preferably run parallel to one another.

The sieve cleaner particularly advantageously has a center region containing the main axis with an upper side opposite the wobble foot which is recessed in respect of the cleaning surfaces in such a manner that it cannot be brought into contact with the sieving surface, in particular it cannot be brought into contact with a substantially planar sieving surface. In particular, the aforementioned upper side does not therefore form a cleaning surface for cleaning the sieving surface. Cleaning surfaces present on the upper side of the center region which were not recessed in respect of the cleaning surfaces of the cleaning elements would cause said cleaning surfaces to come into contact with the sieving surface, even with the sieve cleaner in the untilted state. This would cause the sieve cleaner to slow down or even jam between the sieve bottom and the sieving surface.

The sieve cleaner preferably contains at least three cleaning elements, in particular at least three cleaning arms, as described in detail below. In this embodiment, each of the at least three cleaning arms is provided with a cleaning region, wherein each cleaning region has a plurality of cleaning surfaces for cleaning the sieving surface. The cleaning surfaces are arranged and configured in such a manner that when the sieving tray is inoperative (so particularly in the absence of movements of the sieving tray which support sieving) and when the sieving surface is tightly stretched, the cleaning surfaces of at least two of the cleaning elements, but not the cleaning surfaces of all cleaning elements, are in contact or can be brought into contact with the sieving surface simultaneously, wherein in this case substantially all cleaning surfaces of these cleaning elements are in contact or can be brought into contact with the sieving surface.

In other words, it is not possible for all cleaning elements to be brought into contact with the sieving surface simultaneously. Instead of this, the wobbling movement of the sieve cleaner means that the cleaning surfaces of different cleaning elements repeatedly come into contact with the sieving surface. The slots of the cleaning elements which are not in contact with the sieving surface in each case are each able to be emptied. If, for example, the sieve cleaner contains exactly three cleaning elements, when the sieving tray is at a standstill and the sieving surface is tightly stretched, precisely two cleaning elements are simultaneously in contact with the sieving surface.

If the cleaning surfaces of two or more cleaning elements are simultaneously in contact with the sieving surface, substantially all cleaning surfaces of these cleaning elements are in contact with the sieving surface. In this case "substantially all" means that at least 50%, preferably at least 70%, further preferably at least 90%, and particularly preferably all cleaning surfaces of the aforementioned two cleaning elements are in contact with the sieving surface. In this embodiment it is therefore impossible, for example, for two cleaning elements only to have a single cleaning surface in contact with the sieving surface. In this way, contact with the sieving surface and therefore also the cleaning effect is increased.

The sieve cleaner is advantageously produced from a sufficiently elastic material. For this purpose, it has proved favorable for the sieve cleaner to be produced from a comparatively soft polyurethane, such as Elastollan®, for example, which is available from BASF. Elastollan® is also permitted for the processing of foodstuffs such as grain or milled grain products. Elastic materials have, among other things, the advantage that a sieve frame of the sieving tray is less damaged by the jolting of the sieve cleaner. The sieve cleaners according to the invention can be produced by injection molding, for example.

Likewise, the sieve cleaner advantageously exhibits an odd number of cleaning elements, in particular cleaning arms. In this case, the aforementioned number is preferably at least three and particularly preferably exactly three. Likewise preferably, the cleaning elements are evenly distributed in the circumferential direction. This design is particularly simple and allows an advantageous compromise to be reached between the cleaning action and the free space formed between the cleaning elements, in particular the cleaning arms.

Likewise, it is particularly advantageous for the cleaning element(s) to be configured as (a) cleaning arm(s) which extend(s) from a center region of the sieve cleaner containing the main axis radially outwards. This also contributes to the aforementioned advantageous compromise.

It is likewise preferable for the cleaning surfaces to be arranged in a single row along the cleaning arms. In this way, a sufficiently low sliding friction between the sieve cleaner and sieving surface is likewise achieved, which prevents the slots from becoming clogged with fine material and also prevents the sieve cleaner from being inoperative.

The cleaning arms may exhibit a length falling within the region of 5 to 15 cm, preferably of 6.5 to 7.5 cm. Furthermore, the cleaning regions preferably exhibit a radial length, wherein the ratio of this radial length to the length of the cleaning arms lies in the region of 50 to 100%, and is preferably roughly 85%.

At the outer ends of the cleaning elements, in particular of the cleaning arms, impact protection may be arranged. The risk of the cleaning surfaces wearing out due to contact with the sieve frame can thereby be reduced. The impact protection may take the shape of reinforcements of the cleaning elements, for example, in a plane running perpendicularly to the main axis.

In order to remove from the sieving tray the fine material that has been removed from the sieving surface with the help of the cleaning elements, the sieve cleaner may exhibit at least one clearer for clearing out fine material found on the sieve bottom through a clearing opening formed in a sieve frame of the sieving tray. Advantageously, a clearing opening of this kind is arranged at the end of a cleaning arm.

The sieve cleaner is preferably of one-piece configuration. This makes it easier to produce and, furthermore, reduces the risk of individual components being lost.

Another aspect of the invention relates to a sieve unit. This contains at least one sieving tray with a sieve bottom and a sieving surface, in particular a sieve fabric, and also at least one sieve cleaner which can be placed or is placed on the sieve bottom.

The sieve cleaner of the sieve unit according to the invention has at least three cleaning elements, in particular three cleaning arms, each having a respective cleaning region, wherein each cleaning region has a plurality of cleaning surfaces for cleaning the sieving surface. In this case, the cleaning surfaces are arranged and configured in such a manner that when the sieving tray comes to a standstill (so in particular in the absence of movements of the sieving tray which support sieving) and when the sieving surface is tightly stretched, at least two of the cleaning elements, but not the cleaning surfaces of all cleaning elements, are in contact or can be brought into contact with the sieving surface simultaneously, wherein substantially all cleaning surfaces of these cleaning elements are in contact or can be brought into contact with the sieving surface.

This and other advantages can be achieved in that the sieve cleaner has at least three cleaning elements and the sieve cleaner and the sieving tray are configured and adjusted to one another in such a manner that when the sieving tray is at a standstill (so particularly in the absence of movements by the sieving tray which support sieving), when the sieving surface is correctly clamped and when the wobble foot is placed on the sieve bottom, the cleaning surfaces of all cleaning elements exhibit a spacing of less than 5 mm, preferably of less than 3 mm, particularly preferably of less than 1.4 mm, from the sieving surface. Due to this small maximum spacing from the sieving surface, the speed component perpendicular to the sieving surface, so in particular the vertical speed component at which the cleaning surfaces encounter the sieving surface when the sieve cleaner tilts around the wobble foot, is limited.

As already explained above, efficient cleaning of the sieving surface is also possible when the mesh width of the sieving surface, particularly of the sieve fabric, is smaller than 250 μm, preferably smaller than 180 μm, further preferably smaller than 150 μm, even further preferably smaller than 125 μm, and particularly preferably smaller than 90 μm.

Finally, a further aspect of the invention relates to a method of upgrading or modifying a sieving tray. In this method, a sieve cleaner according to the invention is placed on a sieve bottom of the sieving tray in such a manner that a sieve unit of the kind described above is formed.

Figure 2:
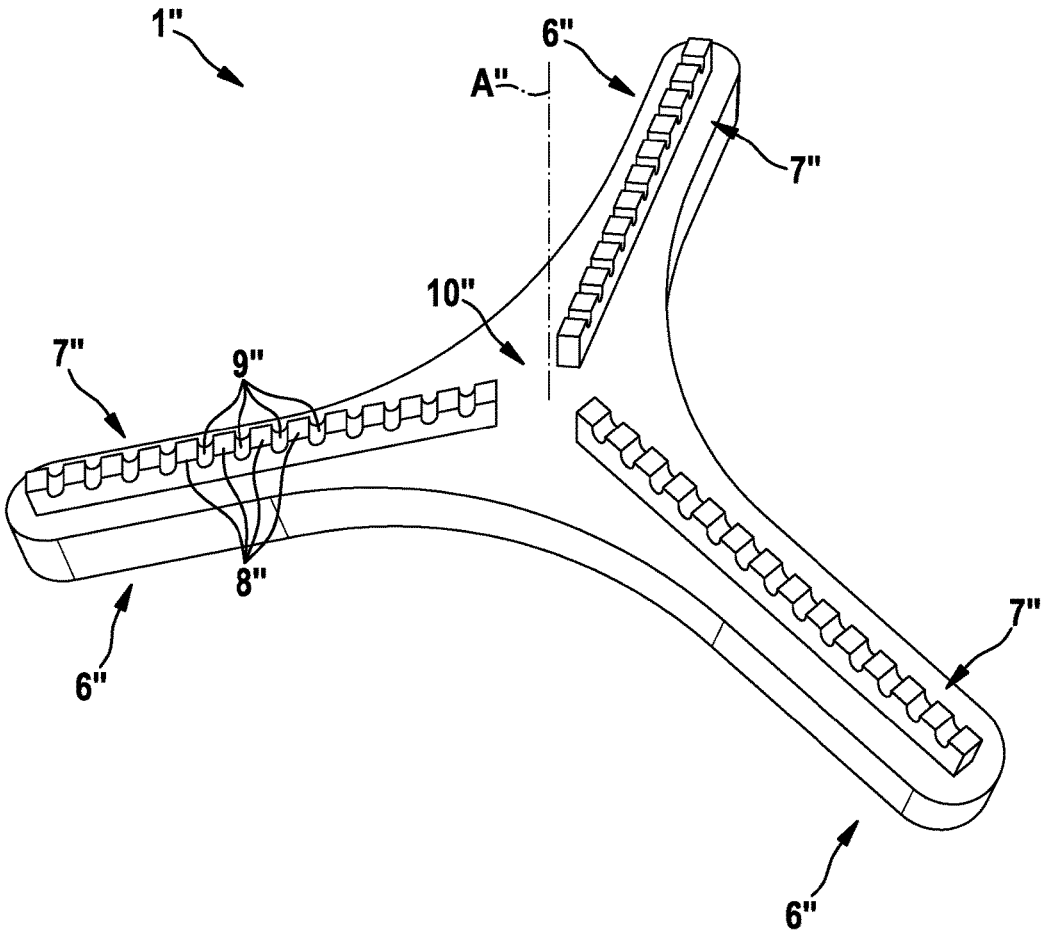
Figure 3:
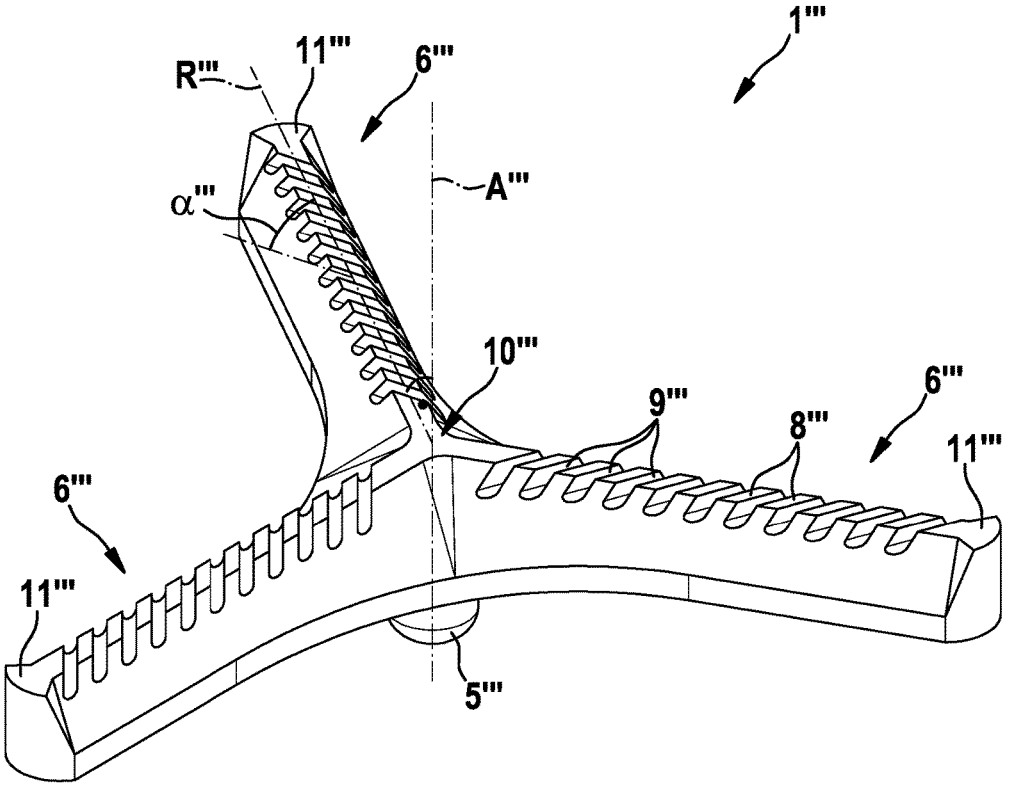
Figure 4:
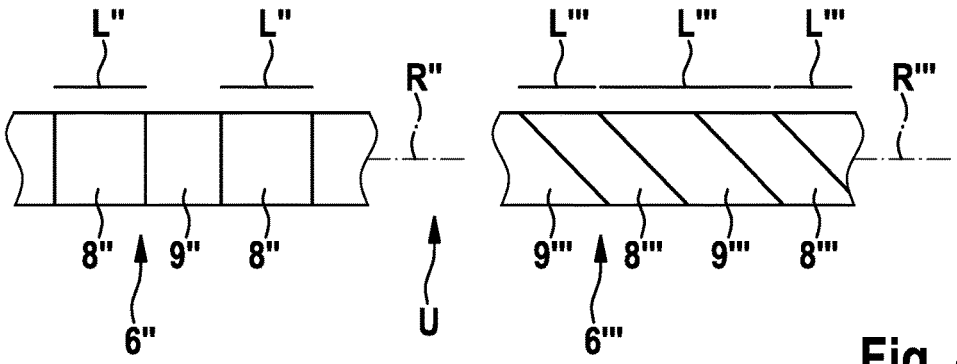

The invention is explained in greater detail below with the help of a plurality of exemplary embodiments and drawings. In these FIG. 1: shows a first sieve cleaner according to the invention as a perspective view;

FIG. 2: shows a second sieve cleaner according to the invention as a perspective view;

FIG. 3: shows a third sieve cleaner according to the invention as a perspective view;

FIG. 4: shows a diagram illustrating the cleaning lines swept over by the cleaning surfaces of the sieve cleaners according to FIGS. 2 and 3;

FIG. 5: shows a fourth sieve cleaner according to the invention as a perspective view;

FIG. 6: shows the fourth sieve cleaner according to the invention as a first side view;

FIG. 7: shows the fourth sieve cleaner according to the invention as a second view;

FIG. 8: shows the fourth sieve cleaner according to the invention as a plan view;

FIG. 9: shows a sectional view of the fourth sieve cleaner according to the invention along the line A-A according to FIG. 8;

FIG. 10: shows a side view of the fourth sieve cleaner according to the invention housed in a sieving tray.

The first embodiment of the sieve cleaner 1' shown in FIG. 1 contains a wobble foot that cannot be identified here. Said wobble foot extends along a main axis A' of the sieve cleaner 1' which also simultaneously forms one of its neutral axes. It is configured like the wobble foot 5 in the fourth exemplary embodiment according to the invention in FIGS. 5 to 9.

From a center region 10' of the sieve cleaner 1' extend three cleaning elements configured as cleaning arms 6' which are distributed uniformly about the neutral axis A' in the circumferential direction. Each of the cleaning arms 6' contains a cleaning region 7' in each case. Each of the cleaning regions 7' has a plurality of rectangular cleaning surfaces 8' which run perpendicularly to the neutral axis A' and are each configured for planar contact with a sieve surface not depicted here (see FIG. 10 for this, which shows a sieving tray and a sieve cleaner according to the invention arranged therein). The cleaning surfaces 8' are separated from one another by the slots 9' formed in the respective cleaning region 7'. In the first exemplary embodiment shown here, the slots 9' extend along a slot direction S' at an angle $\alpha'$ of 90° to a radial direction R' in respect of the neutral axis A'. In other words, the slots 9' therefore extend perpendicularly to the longitudinal direction of the cleaning arms 6'.

There are also cleaning regions 18' in each case in the region between two of the cleaning arms 6', in other words in the center region 10' of the sieve cleaner 1'. In addition, the center region 10' contains three openings 19' through which fine material can pass. When the sieving tray is at a standstill and the sieving surface is tightly stretched, the cleaning surfaces 8' of exactly two of the cleaning arms 6' can always be brought into contact simultaneously with the sieving surface, wherein in this case substantially all cleaning surfaces 8' of these two cleaning arms 6' can be brought into contact with the sieving surface.

The second sieve cleaner 1" according to the invention shown in FIG. 2 differs from that shown in FIG. 1 in that in the center region 10" there are neither cleaning regions 18' nor openings 19'. Due to the non-existence of cleaning regions 18' in the center region 10", there is contact between the sieve cleaner 1" and the sieving surface only in the tilted state of the sieve cleaner 1". This means that a braking or even a jamming of the sieve cleaner 1" between the sieve bottom and the sieving surface can be prevented before said cleaner can tilt at all.

FIG. 3 shows a third sieve cleaner 1'" according to the invention which likewise contains three cleaning arms 6'" distributed uniformly in the circumferential direction. The sieve cleaner 1'" also has a wobble foot 5'" which is rounded at the lower end, as a result of which tilting of the sieve cleaner 1'" is made easier.

Unlike the exemplary embodiments depicted in FIGS. 1 and 2, the slots 9'" formed between the cleaning surfaces 8'" run in a slot direction S'" which creates an angle $\alpha'''$ of 45° in relation to a neutral axis A'" in the radial direction R'". This angle creates a particularly advantageous compromise between the linear support and sliding friction between the sieve cleaner 1'" and sieving surface. Furthermore, at the ends of the cleaning arms 6'", reinforcements 11'" are provided in a plane running perpendicularly to the main axis A'", said reinforcements acting as impact protectors and reducing the risk of damage to the cleaning regions when the sieve cleaner 1'" strikes a sieve frame.

This is explained in greater detail with the help of FIG. 4. This shows a plan view on the left of a detail of a cleaning arm 6" of the sieve cleaner 1" according to FIG. 2 and also, on the right, a plan view of a detail of a cleaning arm 6'" of the sieve cleaner 1'" according to FIG. 3. During movement in the circumferential direction U, the cleaning surfaces 8" or 8'" each sweep over an imaginary cleaning line L" or L'". Due to the oblique position of the cleaning surfaces 8'" and the slots 9'", for the third exemplary embodiment depicted on the right, the ratio of the radial length of the cleaning lines L" and the spacing of two adjacent cleaning lines L" is greater than is the case in the second exemplary embodiment depicted on the left. The linear support is therefore greater in the third exemplary embodiment than in the second. For this reason, the third sieve cleaner 1'" produces more efficient cleaning than the first sieve cleaner 1".

In FIGS. 5 to 9, a preferred sieve cleaner 1 is depicted in a fourth exemplary embodiment. This sieve cleaner 1 may be produced in one piece by injection molding, for example, from the Elastollan® already referred to above. This sieve cleaner 1 also has a wobble foot 5 which extends along a neutral axis A forming the main axis of the sieve cleaner 1. The wobble foot 5 is configured in such a manner that it can be placed on a sieve bottom and the sieve cleaner 1 is tiltable about the wobble foot 5. The wobble foot 5 is, in addition, rounded at the lower end, as a result of which tilting of the sieve cleaner 1 is simplified. The three cleaning arms 6 are also uniformly distributed about the neutral axis A in the circumferential direction in this case. At the ends of the cleaning arms 6, reinforcements 11 are also provided in this exemplary embodiment in a plane running perpendicularly to the main axis A, said reinforcements acting as impact protectors and reducing the risk of damage to the cleaning regions when the sieve cleaner 1 strikes a sieve frame.

Unlike the sieve cleaner 1'" according to FIG. 3, the upper side 15 of the center region 10 is recessed in respect of the cleaning surfaces 8 of the cleaning arms 6, in such a manner that said upper side 15 cannot be brought into contact with a sieving surface. This results in the same advantages as those that have already been explained in connection with FIG. 2. Furthermore, the sieve cleaner 1 contains a clearer 12, with the help of which fine material located on a sieve bottom can be cleared through a clearing opening formed in a sieve frame of the sieving tray.

FIG. 6 shows a first side view of the fourth sieve cleaner 1, FIG. 7 a second side view and FIG. 8 a plan view.

FIG. 9 shows a detailed sectional view along the line A-A according to FIG. 8. It can be seen from this that the cleaning surfaces 8 are rounded. However, because they run in a straight line perpendicularly to this sectional view, a linear contact with a planar sieving surface is made possible.

According to FIG. 9, parallel to the neutral axis A that cannot be seen here, the slots 9 exhibit a depth t=1.5 mm. The ratio between this depth t and the height h of the cleaning arms 6 is roughly 10%.

Finally, a sieve unit is shown in FIG. 10 which contains a sieving tray 3 and one of the preferred sieve cleaners 1 according to the invention. The sieving tray 3 has a horizontal sieve bottom 4, a sieve frame 13 extending in a vertical direction therefrom and also a sieving surface configured as a sieve fabric 2 which is stretched over the sieve frame 13. The sieve cleaner 1 is placed with its wobble foot 5 on the sieve bottom 4. When the sieving tray 3 is at a standstill and the sieve fabric 2 is tightly stretched, the cleaning surfaces of exactly two of the cleaning arms 6 are always simultaneously in contact with the sieve fabric 2. In this case, substantially all cleaning surfaces 8 of these two cleaning arms 6 are then in contact with the sieve fabric 2. In addition, the sieve cleaner 1 is configured in such a manner that the cleaning surfaces 8 of all cleaning arms 6 are constantly at a distance of less than 1.4 mm from the sieve fabric 2.

The invention claimed is:

1. A brushless sieve cleaner for cleaning a sieving surface of a sieve box, said sieve box comprising the sieving surface and a sieve floor, the sieve cleaner comprising:

a wobble foot extending along a main axis of the brushless sieve cleaner and configured such that the wobble foot can be positioned on the sieve floor and the brushless sieve cleaner can be tilted around about the wobble foot; and at least one cleaning element with a cleaning region, which comprises no brushes or bristles, and the, or each, cleaning region having a plurality of cleaning surfaces for cleaning the sieving surface;

wherein each individual one of the plurality of cleaning surfaces is configured and arranged so as to be capable of making contact with the sieving surface along at least a line of contact, whereby upon rotation of the brushless sieve cleaner about the main axis, each cleaning surface sweeps out a planar region, and each of the plurality of cleaning surfaces is separated from each neighboring cleaning surface by a slot formed in the cleaning region, wherein each slot extends in a slot direction which is at an angle to a radial direction with respect to the main axis which is in a range of 30° to 60°.

2. The brushless sieve cleaner as claimed in claim 1, wherein each of the planar regions swept across by each of the cleaning surfaces defines a notional cleaning line which corresponds to a radial dimension of the planar region in a radial direction with respect to the main axis; and the cleaning surfaces and the slots are configured and arranged in such a manner that any gap which may exist between the notional cleaning line of a first one of the cleaning surfaces and the notional cleaning line of a neighboring one of the cleaning surfaces has a length of less than the length of the notional cleaning line of the first one of the cleaning surfaces.

3. The brushless sieve cleaner as claimed in claim 1, wherein the cleaning elements exhibit a height parallel to the main axis and the slots exhibit a depth parallel to the main axis, and the depth of the slots is greater than 0% and less than or equal to 20% of the height of the cleaning elements.

4. The brushless sieve cleaner as claimed in claim 1, wherein the brushless sieve cleaner has a central region which contains the main axis with an upper side opposite the wobble foot which is recessed with respect to the cleaning surfaces such that the central region cannot be brought into contact with the sieving surface.

5. The brushless sieve cleaner as claimed in claim 1, wherein the sieve cleaner comprises at least three cleaning elements each with a cleaning region, each cleaning region comprises a plurality of cleaning surfaces for cleaning the sieving surface and the cleaning elements, the cleaning regions and the cleaning surfaces are arranged and configured such that when the brushless sieve cleaner is positioned on the sieve floor and when the sieve box is at a standstill and when the sieving surface is taut, more than 50% of the cleaning surfaces of at least two of the cleaning elements are simultaneously in contact with the sieving surface, but it is not possible for all of the cleaning surfaces of all of the cleaning elements to be simultaneously in contact with the sieving surface.

6. The brushless sieve cleaner as claimed in claim 1, wherein the brushless sieve cleaner has an odd number of cleaning elements.

7. The brushless sieve cleaner as claimed in claim 1, wherein the cleaning element(s) is/are configured as cleaning arm(s) which extend(s) radially outward from a central region of the brushless sieve cleaner containing the main axis.

8. The brushless sieve cleaner as claimed in claim 7, wherein the cleaning surfaces are arranged in a single row along the cleaning arms.

9. The brushless sieve cleaner as claimed in claim 7, wherein the cleaning arms have a length which falls within a range of 5 to 15 cm.

10. The brushless sieve cleaner as claimed in claim 1, wherein the brushless sieve cleaner has at least one clearer for clearing out fine material found on the sieve floor through an opening formed in the sieve box.

11. A sieve unit containing:

at least one sieve box with a sieve floor and a sieving surface;

at least one brushless sieve cleaner which is positioned on the sieve floor, wherein the brushless sieve cleaner comprises a wobble foot which extends along a main axis of the brushless sieve cleaner and is configured in such a manner that the wobble foot can be positioned on the sieve floor and the brushless sieve cleaner can be tilted around about the wobble foot, and the brushless sieve cleaner further comprises at least three cleaning elements each with a cleaning region, each cleaning region comprises a plurality of cleaning surfaces for cleaning the sieving surface, and the cleaning elements, the cleaning regions and the cleaning surfaces are arranged and configured such that when the brushless sieve cleaner is positioned on the sieve floor and when the sieve box is at a standstill and when the sieving surface is taut, more than 50% of the cleaning surfaces of at least two of the cleaning elements are simultaneously in contact with the sieving surface, but it is not possible for all of the cleaning surfaces of all of these cleaning elements to be simultaneously in contact with the sieving surface, each of the plurality of cleaning surfaces is separated from each neighboring cleaning surface by a slot formed in the cleaning region, wherein each slot extends in a direction which is at an angle to a radial direction with respect to the main axis which is in a range of 30° to 60.

12. The sieve unit as claimed in claim 11, wherein the wobble foot, the cleaning elements, the cleaning regions, the cleaning surfaces and the sieve box are arranged and configured with respect to one another such that when the sieve box is at a standstill and when the sieving surface is taut and when the wobble foot is positioned on the sieve floor, each and every one of the cleaning surfaces of all of the cleaning elements of all the cleaning regions is either in contact with the sieving surface or is spaced by less than 5 mm from the sieving surface.

13. A method of upgrading or modifying a sieve box, involving a step in which a brushless sieve cleaner is placed on a sieve floor of the sieve box such that a sieve unit is formed comprising at least said sieve box and said brushless sieve cleaner, wherein the brushless sieve cleaner is a brushless sieve cleaner for cleaning a sieving surface of the sieve box, said sieve box containing the sieving surface and the sieve floor, the brushless sieve cleaner comprising:

a wobble foot extending along a main axis of the brushless sieve cleaner and configured such that the wobble foot can be positioned on the sieve floor and the brushless sieve cleaner can be tilted around about the wobble foot; and at least three cleaning elements each with a cleaning region, which comprises no brushes or bristles, and each cleaning region has a plurality of cleaning surfaces for cleaning the sieving surface, and wherein each of the plurality of cleaning surface is separated from each neighboring cleaning surface by a slot formed in the cleaning region, wherein each slot extends in a direction which is at an angle to a radial direction with respect to the main axis which is in a range of 30° to 60°;

each individual one of the plurality of cleaning surfaces is configured and arranged so as to be capable of making contact with the sieving surface along at least a line of contact, whereby upon rotation of the brushless sieve cleaner about the main axis each cleaning surface sweeps out a planar region, each of the plurality of cleaning surfaces is separated from each neighboring cleaning surface by a slot formed in the cleaning region, and the cleaning elements, the cleaning regions and the cleaning surfaces are arranged and configured such that when the brushless sieve cleaner is positioned on the sieve floor and when the sieve box is at a standstill and when the sieving surface is taut, more than 50% of the cleaning surfaces of at least two of the cleaning elements are simultaneously in contact with the sieving surface, but it is not possible for all of the cleaning surfaces of all of the cleaning elements to be simultaneously in contact with the sieving surface.

* * * * *